US008720934B2

(12) United States Patent
Meyer et al.

(10) Patent No.: US 8,720,934 B2
(45) Date of Patent: May 13, 2014

(54) BOARD FOR GLIDING WITH DECORATIVE COMPONENT

(75) Inventors: Anne-Laure Meyer, Grenoble (FR); Jacky Christoud, Saint Cassien (FR); Bernard Chaumat, Chirens (FR); Cedric Gaboyer, Izeaux (FR)

(73) Assignee: Skis Rossignol, Saint-Jean-de Moirans (FR)

( * ) Notice: Subject to any disclaimer, the term of this patent is extended or adjusted under 35 U.S.C. 154(b) by 295 days.

(21) Appl. No.: 12/848,826

(22) Filed: Aug. 2, 2010

(65) Prior Publication Data

US 2011/0031720 A1 Feb. 10, 2011

(30) Foreign Application Priority Data

Aug. 6, 2009 (FR) ..... 09 55521

(51) Int. Cl.
*A63C 5/04* (2006.01)

(52) U.S. Cl.
USPC ..... 280/609; 280/610; 280/809

(58) Field of Classification Search
USPC ..... 280/609, 610, 809, 814, 87.042, 637; 441/70, 75
See application file for complete search history.

(56) References Cited

U.S. PATENT DOCUMENTS

| | | | | |
|---|---|---|---|---|
| 3,899,186 | A * | 8/1975 | Matsuda | 280/607 |
| 5,437,755 | A * | 8/1995 | Lavorel et al. | 156/240 |
| 5,558,552 | A * | 9/1996 | Namur | 441/75 |
| 5,591,060 | A * | 1/1997 | Forsyth | 441/75 |
| 5,944,335 | A * | 8/1999 | Riepler | 280/602 |
| 6,390,872 | B1 * | 5/2002 | Davis | 441/75 |
| 6,406,054 | B1 * | 6/2002 | Huyghe | 280/610 |
| 6,478,917 | B1 * | 11/2002 | Magoni et al. | 156/245 |
| 6,688,632 | B2 * | 2/2004 | Merino et al. | 280/609 |
| 6,702,328 | B2 * | 3/2004 | Malleis et al. | 280/809 |
| 7,118,117 | B2 * | 10/2006 | Terry | 280/87.042 |
| 7,147,399 | B2 * | 12/2006 | Viscount et al. | 403/349 |
| 7,261,791 | B2 * | 8/2007 | Chaumat et al. | 156/245 |
| 7,404,564 | B2 * | 7/2008 | Bregeon et al. | 280/14.21 |
| 7,481,689 | B2 * | 1/2009 | Wiginton | 441/75 |
| 7,487,991 | B2 * | 2/2009 | Degasperi et al. | 280/607 |
| 8,113,533 | B2 * | 2/2012 | Largueze et al. | 280/609 |
| 2002/0130509 | A1 * | 9/2002 | Leaf et al. | 280/814 |
| 2004/0072482 | A1 * | 4/2004 | Runyan | 441/70 |
| 2008/0079238 | A1 * | 4/2008 | Geisler et al. | 280/610 |
| 2008/0185800 | A1 * | 8/2008 | Christoud et al. | 280/21.1 |

(Continued)

FOREIGN PATENT DOCUMENTS

| | | |
|---|---|---|
| EP | 0 774 280 A | 5/1997 |
| EP | 1 247 550 A | 10/2002 |
| EP | 1 479 416 A | 11/2004 |
| EP | 1 952 852 A | 8/2008 |

OTHER PUBLICATIONS

Search Report issued by French Patent Office for priority application FR 09 55521, dated Mar. 5, 2010.

*Primary Examiner* — Katy M Ebner
(74) *Attorney, Agent, or Firm* — Frommer Lawrence & Haug LLP; Ronald R. Santucci

(57) ABSTRACT

A protective top surface (6) for a board for gliding, which comprises at least one decorative component (10; 10') passing through at least one slot or hole (7; 7') in the protective top surface (6), comprising at least one lower part (11; 11') arranged under the protective top surface (6) and at least one upper part (12) arranged above the protective top surface (6).

15 Claims, 3 Drawing Sheets

(56) References Cited

U.S. PATENT DOCUMENTS

2008/0238040 A1* 10/2008 Avgustin et al. ..... 280/601
2009/0115181 A1* 5/2009 Atherton ..... 280/809
2012/0196079 A1* 8/2012 Brauers et al. ..... 428/116

* cited by examiner

BOARD FOR GLIDING WITH DECORATIVE COMPONENT

The invention relates to a board for gliding, of the ski or snowboard type, which comprises a decorative component. The invention likewise relates to a protective top surface, with decoration, of such a board for gliding. The invention also relates to a method for producing such a protective top surface for a board for gliding, which comprises a method for decorating the top surface thereof.

Certain methods for decorating the top surface of a board for gliding consist in adding decorative parts. These methods have to comply with numerous constraints, including:

- as far as possible, remaining compatible with existing methods for producing a board for gliding, in particular with methods involving the use of a mold, adhesives of epoxy resin or polyurethane foam type in the expansion phase thereof, for economic reasons and in order not to adversely affect the performance of the board for gliding;
- withstanding the fragility acquired by the bonding material as a result of local overpressures following the addition of decorative parts that give rise to extra thickness; and
- achieving high strength in order not to tear off through the effect of any impact with the edges of the board for gliding or through the effect of flexing of the board for gliding during the use thereof, or through the effect of impacts during handling or transportation thereof. The decoration must also withstand constraints connected with extreme environmental conditions of low temperature, moisture, sunshine, etc.

Document EP 1 247 550 describes a method for manufacturing a board for gliding that consists in producing a decorative component by means of a decorative insert made from polymeric material inserted in a recess in the top surface of the board for gliding. A large-size polymer film is placed under the insert to guarantee sealing and to prevent an adhesive rising towards the top surface of the board for gliding via the recesses.

Document EP 1 952 852 describes a variant of the above manufacturing method adapted for the use of inserts made from non-impregnated fibrous material, of flexible-fabric type, that extend at least in part under the top surface of the board for gliding and are protected by a sealing film of larger size.

Lastly, said methods for decorating the surface of a board for gliding consist in the juxtaposition of different components on the top surface thereof, ensuring that a decorated, planar upper surface is achieved for the decoration.

Nowadays, there is a need to replace existing solutions for the decoration of boards for gliding with a new solution.

Thus, a general object of the invention is to propose a solution for decorating the upper surface of a board for gliding. To that end, the invention relates to a protective top surface for a board for gliding, which comprises at least one decorative component passing through at least one slot or hole in the protective top surface, comprising at least one lower part arranged under the protective top surface and at least one movable upper part arranged above the protective top surface.

The invention is more precisely defined by the claims.

These objects, features and advantages of the present invention will be set out in detail in the following description of a particular embodiment given by way of non-limiting example in connection with the attached figures, wherein.

The invention will now be explained in detail on the basis of implementation on a ski. Naturally, the invention could apply to any other board for gliding, such as a snowboard.

Figure 1:
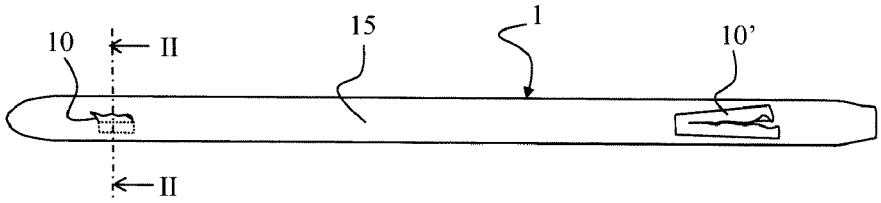
FIG. 1 shows a top view of a ski comprising decorative components according to one embodiment of the invention.
Figure 2:
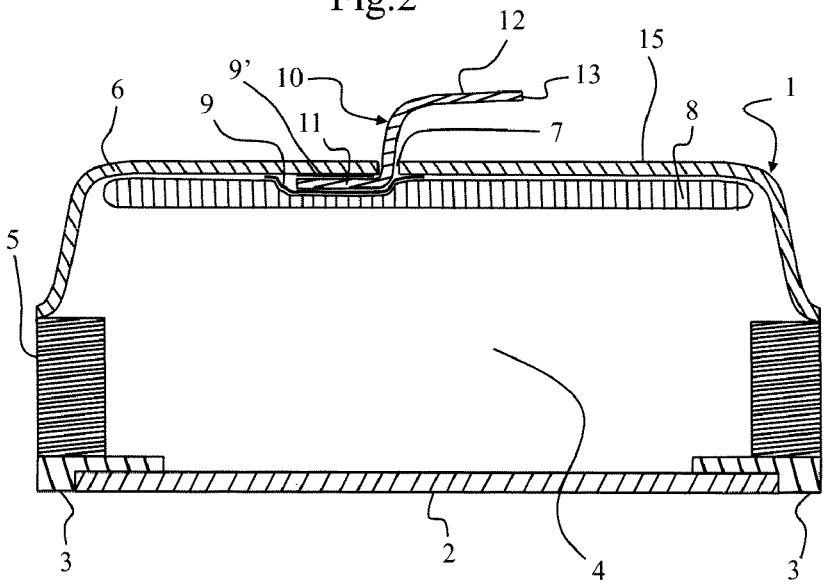
FIG. 2 shows a transverse-sectional view along II-II of the ski according to the embodiment of the invention.

FIGS. 1 and 2, therefore, illustrate one embodiment of a ski 1 according to the invention, which comprises two decorative components 10, 10' placed on the upper surface 15 thereof.

The ski comprises, conventionally, a base 2 bordered with edges 3. A core 4, which may be obtained in different ways, either from a component produced separately or formed by injection-molding, is arranged on the base 2, possibly by means of a lower reinforcement (not shown) and possibly bordered by longitudinal reinforcements 5.

As a variant, the lower structure of the board for gliding could have any other conventional prior-art structure, such as "sandwich"- or "shell"-type structures.

The invention relates to the upper part of the board for gliding, the upper surface 15 of which, which is visible while skiing, has a decoration. To that end, said upper surface is obtained principally by means of a protective top surface 6 that extends from a first side reinforcement 5 to the second side reinforcement 5.

According to an essential aspect of the invention, said protective top surface 6 has at least one slot or a hole 7 through which passes a decorative component 10, which has a lower first part 11 under the protective surface 6 and a second, upper part 12 above the upper surface 15.

According to this embodiment shown in FIG. 2, the upper part 12 of the decorative component 10 has a free end 13 and is able to move in the manner, for example, of a clothing label in the case of a decorative component made from flexible textile-type material based on non-impregnated fibrous material.

The slot 7 may have any orientation and any length, and a very narrow width of less than 2 millimeters, and advantageously less than 1 millimeter, which corresponds to the thickness of the decorative component 10. It may be produced by any punching, drawing or cutting operation on the reinforcing top surface 6 of the ski. It may, for example, be obtained by simply cutting in with a blade, without removing material at the cut. In such a case, the slot will simply be opened up upon passage of the decorative component, in order to match the size thereof exactly. The slot may also be of any length, even a very short length, in which case it has the form of a hole. Lastly, the slot may also have a width that is greater than the thickness of the decorative component, without thereby departing from the concept of the invention. This solution offers the advantage of a high degree of simplicity, since there is no need to make recesses to precise dimensions in order to accommodate an insert in the recesses. On the contrary, the top surface 6 of the board for gliding remains practically intact, has a substantially planar and continuous upper surface 15 and there is a high degree of tolerance as to the size of the slots in order to achieve a satisfactory result. It follows that this is a simpler, more economical method of decoration, although one that offers numerous possibilities, as will be illustrated below.

As a variant, the hole may be of any size that allows the passage of a decorative component in the form of a cord or string, up to a diameter being less or equal to 5 millimeters, preferably less than 2 millimeters.

Next, the board for gliding may, in a known manner, comprise a reinforcing layer 8 placed between the core 4 and the assembly formed by the top surface 6 and the decorative component 10. Furthermore, a sealing layer 9 extends under the protective surface 6 so as fully to cover the slot 7 and the lower part 11 of the decorative component 10, and even to extend beyond the border of said lower part 11 and of the slot 7 in order to come into contact with the lower surface of the top surface 6 to guarantee sealing vis-à-vis the lower components of the ski structure. Moreover, with a view to further improving attachment of the decorative component 10, another adhesive-bonding component 9' may be positioned between the lower part 11 of the decorative component 10 and the lower surface of the protective surface 6.

Naturally, the upper assembly of the ski may also comprise other reinforcing components or other structures, without thereby departing from the concept of the invention.

The protective top surface 6 is conventionally produced from a polymeric material of thermoplastic type and may, on the lower and/or upper face thereof, receive various coats of ink or varnish. In certain variant embodiments, the protective top surface may be produced from leaves of various materials, such as wood-based leaves, in particular bamboo or the like, and, generally speaking, any other plant material. Textiles that differ from those forming the additional component in terms of material, color or, more generally, appearance, may also be used. Thus, the term "protective top surface" is used to describe any top surface of the board for gliding that may possibly be covered with a coat of varnish or ink, or a thin film, which fulfils the function of protecting the core of the structure of the board for gliding and serves as support for the decoration of the board for gliding.

The fibrous reinforcing layer 8 may be produced in various ways and, in particular, from one or more sheets of woven or non-woven threads. Said sheet is impregnated with a heat-curable resin, which, when fully cross-linked, confers great rigidity on the sheet, which contributes to the stiffness of the board.

Typically, the resins used may be based on epoxy or polyurethane compounds.

In accordance with the invention, the top surface 6 of the ski allows the passage of a decorative component 10, which may be made from numerous different materials in order to obtain different esthetic effects. By way of example, denim-fabric-type woven materials, which may have undergone ageing operations, and which exhibit satisfactory resistance to scratching and impact with the edges may be cited, or, alternatively, materials of greater thickness, of the wool knit type, in particular. This textile may also include various supplementary decorative components, such as printed motifs or components such as embroidery, stitching or the like. The textile may also be perforated, as is the case of lace or the like. According to a further example, the decorative component may be made from any plastic or metallic material, such as plastic sheet or a metal strip.

The sealing layer 9 envisaged may be produced from a film of the multi-layer type to ensure satisfactory sealing and adhesive bonding to the adjacent layers. They may comprise a polymeric material forming a sealing barrier. With a view to preventing any migration of resin from the reinforcing layer 8 towards the decorative component 10, particularly when the latter is made from a textile material, the lower sealing layer 9 extends beyond the periphery of the textile layer by a distance that is established as a function of the viscosity of the resin used, molding temperatures, the porosity of the textile layer, and operating conditions. In practice, said distance may be of the order of a few millimeters or centimeters, at least equal to 1 millimeter.

Furthermore, the decorative component 10 comprises a lower part 11 that extends under the protective top surface 6 by a certain minimal distance, to ensure the holding thereof. In the case of a decorative component made from a textile material, the lower part 11 may have a length that is at least between 5 and 15 millimeters, and at least 10 millimeters in the case of a small label. Said length is increased for a larger label or for any decorative component that might be subject to significant tearing forces. As a variant, the protective top surface of the board for gliding may be transparent at the location of the decoration in order to render that part of the decorative component that is positioned under the protective layer visible, in which case, said lower part may be longer, for esthetic purposes.

The invention also relates to the method for producing a protective top surface for a board for gliding, which comprises securing the decorative component 10 to the protective top surface 6, in which one or more slots and/or holes have previously been made. This assembly may be obtained, for example, by means of one or more sealing layers 9, by adhesive bonding, stitching or any other fastening means. In the case of stitching, the stitching thread that forms the assembly may be used to create a decorative effect such as embroidery, by passing continuously from visible areas of the textile layer of the additional component to the protective top surface.

Said assembly, which forms a decorated protective top surface, is then assembled together with, in particular, a core, in order to form the complete structure of a board for gliding. All the component parts of the board for gliding are placed in a mold, the mold cover is then closed and high temperature and pressure are applied, thereby provoking, first, the cross-linking of the resin contained in the reinforcing layer 8 and the deformation of the various layers such as to result in the board for gliding with its final geometry. Incidentally, the mobility of the decorative component on the top of the decorative surface allows easy positioning thereof in a production mold since the decorative component may be squashed against the upper surface of the decorative layer.

The concept of the invention makes it possible to achieve different esthetic effects, certain variants of which are shown diagrammatically, by way of examples, in FIGS. 3 to 6. The same reference numerals are used for corresponding components in these various figures.

Figure 3:
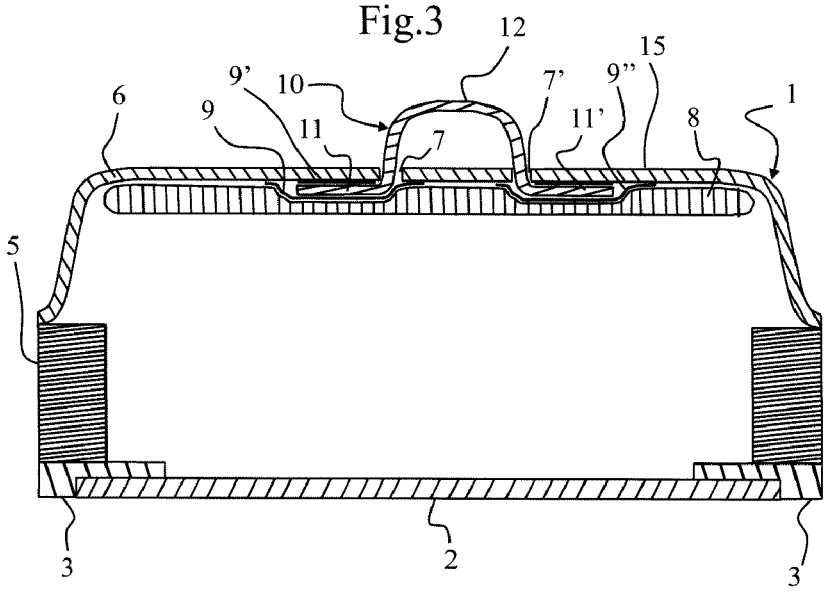
FIG. 3 shows a transverse-sectional view of a ski comprising a decorative component according to a first variant of the embodiment of the invention.

FIG. 3 shows a variant embodiment in which one and the same decorative component 10 passes through two different slots 7, 7' in the protective surface 6, such that the upper part 12 thereof is held above the upper surface 15 of the board for gliding by two ends. The decorative component thus no longer has a free end, but a first lower part 11 extending from the first slot 7 and a second lower part 11' extending from the second slot 7'. These different lower parts 11, 11' are protected from the rest of the ski structure by a sealing component 9 and adhesively bonded by adhesive-bonding components 9', 9". Naturally, the decorative component 10 could even pass through more than two slots 7, 7' in the top surface of the board for gliding.

Figure 4:
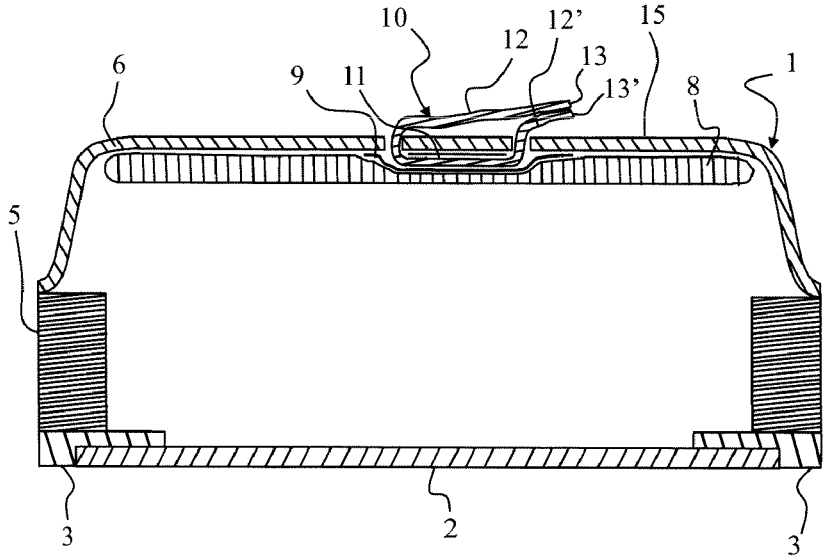
FIG. 4 shows a transverse-sectional view of a ski comprising a decorative component according to a second variant of the embodiment of the invention.

FIG. 4 shows a further variant embodiment in which the decorative component 10 passes also through two slots 7, 7' such that the two ends 13, 13' of two distinct upper parts 12, 12' thereof are free above the surface 15 of the board for gliding. Said two free ends 13, 13' may be fastened together, as shown, or separate. In such a configuration, it is possible, particularly in the case of a decorative component made from textile material, to envisage positioning a sealing component 9 extending from one slot 7 to the other 7', covering the lower part 11 of the decorative component and extending slightly beyond the slots 7, 7', for example by a few millimeters and advantageously by at least 1 millimeter.

Figure 5:
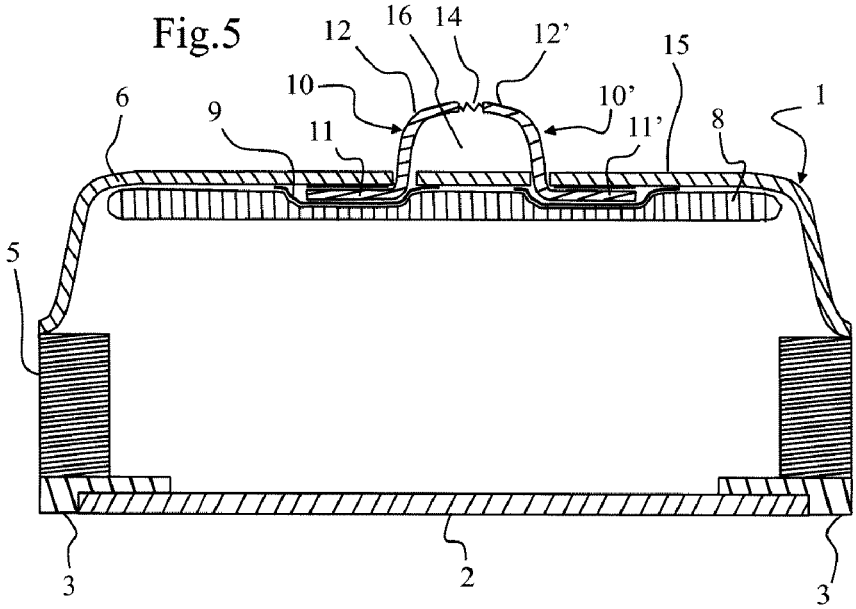
FIG. 5 shows a transverse-sectional view of a ski comprising a decorative component according to a third variant of the embodiment of the invention.

FIG. 5 shows a further variant embodiment in which two distinct decorative components 10, 10' are arranged symmetrically in the upper structure of the board for gliding such that the two free ends 13, 13' thereof face one another and can be connected by a fastening device, such as a zipper 14, either purely for decorative purposes or to form a storage pocket 16 on the surface of the board for gliding.

Figure 6:
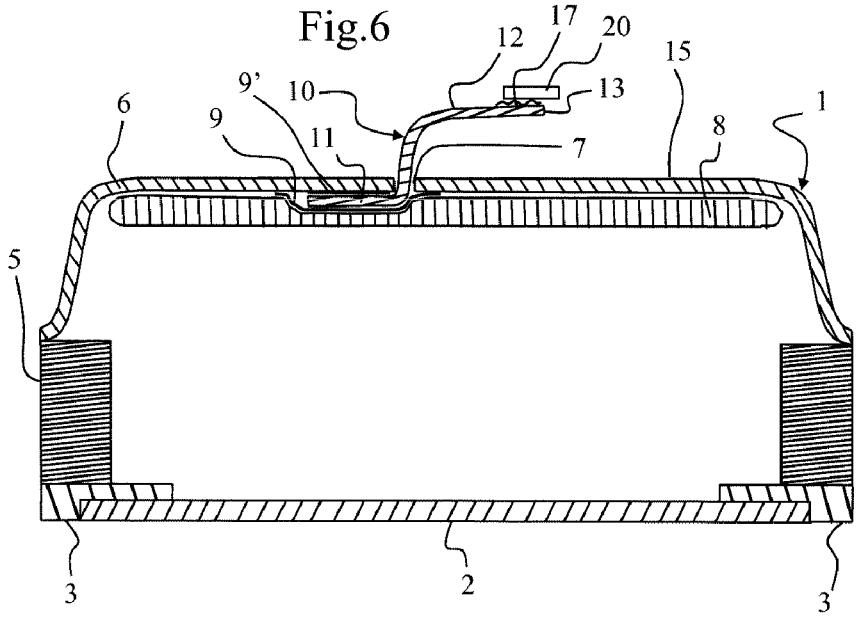
FIG. 6 shows a transverse-sectional view of a ski comprising a decorative component according to a fourth variant of the embodiment of the invention.

FIG. 6 shows a further variant embodiment in which the free end 13 of the upper part 12 of the decorative component is equipped with a linking device 17, of the hook-and-loop type (Velcro type), for example, allowing the fastening of an accessory or of a distinct, removable, additional decorative component 20.

Numerous other variant embodiments may easily be inferred from the preceding examples, for instance by combining those examples. The decorative component 10 may thus have a plurality of lower parts 11 and/or a plurality of upper parts 12.

Thus, in all cases, the decorative component has an independent part above the surface of the board for gliding, which is not fixed to said surface, which is able to move relative to said surface owing to the suppleness or flexibility thereof. For example, in the embodiments shown in FIGS. 2, 4 and 6, the decorative component, which has the form of a label positioned through a slot or of a cord positioned through a hole, has a free end above the surface of the board for gliding that is movable relative to said board for gliding. In the embodiments illustrated by FIGS. 3 and 5, the decorative component does not have a free end but has a free central part that may present a space above the decorative surface of the board for gliding and in any event having such flexibility and suppleness as to allow it to move relative to the surface of the board for gliding. Thus, in all cases, the invention implements the concept of a decorative component that is movable relative to the surface of a board for gliding, which enables it to have different appearances over time, owing to the deformation thereof relative to the surface of the board for gliding. Said deformation may be obtained automatically, naturally owing to the fact that the material used is very supple and owing to the freedom of movement thereof, being moved simply by a gust of wind, or may require manual intervention from the user in the case of a more rigid but deformable and mobile material.

Furthermore, the decorative component may be in the form of a single piece, which facilitates the production thereof. However, it may also be produced by means of the assembly of a number of pieces, by stitching, by adhesive bonding, etc., if such a method produces a desired esthetic appearance.

Lastly, the invention has been presented as offering numerous decorative possibilities using a "decorative" component. However, it is compatible with other applications in which the decorative component may, moreover, fulfill technical functions, which may even be preferred over the decorative aspect, without thereby departing from the scope of the present invention. Thus, the free end of the decorative component may form a grip for facilitating transportation and fastening of the board for gliding. Said free end may, in a variant embodiment, be adapted for fastening a distinct handle. Furthermore, the free end may be sufficiently long to allow two skis to be attached to one another, for example, to enhance storage and transportation thereof. Moreover, as mentioned, the decorative component may serve as a support for the fastening of accessories, such as a brake, or for the fastening of decorative components. Lastly, it may form storage pockets on the surface of the board for gliding, allowing, for example, the storage of keys, a lift ticket, pocket book, etc.

Naturally, the invention does not relate to the shape of the decorative component per se, which may take any form. The slot on the board for gliding may thus itself be of any suitable shape and size, be rectilinear, curved, etc. Furthermore, a plurality of independent decorative components may, of course, be placed on one and the same board for gliding. Lastly, it should be noted that the present decoration of the invention may be combined with other, existing methods for decoration.

The invention claimed is:

1. A board for gliding, comprising:

a protective top surface; and at least one decorative component, the at least one decorative component comprising:

a. at least one lower part bonded under the protective top surface;

b. at least one movable upper part arranged above the protective top surface; and c. at least an intermediate part passing through at least one slot or hole in the protective top surface, said slot or hole having a width matching the thickness of said intermediate part of the decorative component;

wherein the decorative component is made from a supple material and in the form of a single piece.

2. The board for gliding as claimed in claim 1, wherein the at least one decorative component is formed by a layer of non-impregnated fibrous material of textile or fabric, and which comprises a sealing component extending under the at least one lower part of the decorative component and under the at least one slot or hole, extending beyond this at least one lower part and the at least one slot or hole in order to come into contact with the lower face of the protective top surface.

3. The board for gliding in claim 2, wherein the sealing component comprises a polymeric material that forms a sealing barrier.

4. The board for gliding as claimed in claim 1, which comprises a core covered with a polymerized-resin-impregnated reinforcing layer, wherein the at least one decorative component is formed from a layer of non-impregnated fibrous material, and which comprises a sealing component extending under the at least one lower part of the decorative component and under the at least one slot or hole, extending beyond this at least one lower part and the at least one slot or hole in order to come into contact with the lower face of the protective top surface and to form a sealing barrier between the resin of the reinforcing layer and the decorative component.

5. The board for gliding as claimed in claim 1, wherein an end of the upper part is free to move.

6. The board for gliding as claimed in claim 1, wherein the decorative component passes through two slots or holes in the protective top surface, and includes two lower parts under the protective top surface and an upper part above the protective top surface.

7. The board for gliding as claimed in claim 1, wherein the decorative component passes through two slots or holes in the protective top surface, and includes a lower part under the protective top surface and two upper parts above the protective top surface.

8. The board for gliding as claimed in claim 1, which comprises two decorative components, each decorative component comprising an upper part, of which the ends are connected by a zipper fastening component.

9. The board for gliding as claimed in claim 1, which comprises a decorative element, of which the upper part comprises a linking component of hook-and-loop type, or forms a handle or forms a strip of sufficient length to form a strap for carrying the board for gliding.

10. The board for gliding as claimed in claim 1, wherein the at least one decorative component comprises a textile fibrous material and/or a plastic and/or a metallic material.

11. The board for gliding as claimed in claim 1, wherein the at least one slot has a width of no more than 2 millimeters or wherein the at least one hole has a diameter of no more than 5 millimeters.

12. A method for producing a board for gliding as claimed in claim 1, which comprises: a step of making the at least one slot or hole in the protective top surface of the board for gliding, and passing the decorative component through the at least one slot or hole.

13. The method for producing a board for gliding as claimed in claim 12, which comprises a supplementary step consisting in covering a lower part of the decorative component with a sealing element with dimensions greater than those of the lower part and of the slot or hole that it passes through in order to guarantee the seal.

14. A method for producing a board for gliding, which comprises a step of producing a protective top surface as claimed in claim 12, and a step of assembling a core with the protective top surface and the at least one decorative component thereof.

15. A board for gliding as claimed in claim 1, wherein the lower part of the decorative component is fixed between the protective top surface and a reinforcing layer or a core of the board for gliding.

* * * * *